US008833615B2

(12) United States Patent
Neukirch et al.

(10) Patent No.: US 8,833,615 B2
(45) Date of Patent: Sep. 16, 2014

(54) DISPOSABLE CONTAINER WITH FITTING ATTACHMENT

(75) Inventors: Werner Neukirch, Andermach (DE); Hans Peter Sauer, Muelheim-Kaerlich (DE)

(73) Assignee: Ardagh MP Group Netherlands B.V., Deventer (NL)

( * ) Notice: Subject to any disclaimer, the term of this patent is extended or adjusted under 35 U.S.C. 154(b) by 123 days.

(21) Appl. No.: 13/502,840

(22) PCT Filed: Jul. 15, 2010

(86) PCT No.: PCT/EP2010/060261

§ 371 (c)(1),
(2), (4) Date: Apr. 19, 2012

(87) PCT Pub. No.: WO2012/007041

PCT Pub. Date: Jan. 19, 2012

(65) Prior Publication Data

US 2012/0205403 A1 Aug. 16, 2012

(51) Int. Cl.

| | |
|---|---|
| ***B65D 83/00*** | (2006.01) |
| ***B65D 21/02*** | (2006.01) |
| ***B67D 7/02*** | (2010.01) |
| ***B67D 1/08*** | (2006.01) |
| ***B65D 1/16*** | (2006.01) |

(52) U.S. Cl.

CPC ..... *B67D 1/0832* (2013.01); *B65D 21/0224* (2013.01); *B67D 7/0294* (2013.01); *B65D 1/16* (2013.01)

USPC ..... 222/394; 222/399; 220/592.19

(58) Field of Classification Search

CPC ..... B65D 7/34; B65D 7/22; B65D 39/082; B65D 39/084; B65D 39/086; B65D 1/16; B65D 7/0294; A47F 19/2255; B67D 1/083; B67D 7/0294

USPC ..... 222/394, 399, 105; 220/254.5, 592.19, 220/649, 729, 601, 610, 639

See application file for complete search history.

(56) References Cited

U.S. PATENT DOCUMENTS

| | | | | |
|---|---|---|---|---|
| 4,187,963 | A * | 2/1980 | Mascia | 222/402.13 |
| 8,360,277 | B2 * | 1/2013 | Rasmussen | 222/83.5 |
| 8,490,836 | B2 * | 7/2013 | Rasmussen | 222/146.6 |

(Continued)

FOREIGN PATENT DOCUMENTS

| | | | |
|---|---|---|---|
| DE | 10138365 | A1 | 2/2003 |
| DE | 102006061120 | A1 | 6/2008 |

(Continued)

OTHER PUBLICATIONS

Ferrien, Yann; International Search Report; International Application No. PCT/EP2010/060261; Mar. 18, 2011; pp. 1-2; European Patent Office; Rijswijk NL.

(Continued)

*Primary Examiner* — Lien Ngo

(74) *Attorney, Agent, or Firm* — Stevens & Showalter, LLP

(57) ABSTRACT

The invention relates to a single use container for pressurized liquid, in particular beer, comprising a receptacle providing a storage volume for the liquid, a top attachment unit which is arranged on top of the receptacle, and a fitting which is arranged sealingly in a filling hole that is formed in the receptacle for the feeding and tapping of liquid.

12 Claims, 4 Drawing Sheets

(56) References Cited

U.S. PATENT DOCUMENTS

| | | | | |
|---|---|---|---|---|
| 2010/0072212 | A1 | 3/2010 | Howard et al. | |
| 2011/0017737 | A1* | 1/2011 | Apps | 220/254.1 |
| 2011/0180535 | A1* | 7/2011 | Apps | 220/254.1 |
| 2013/0206762 | A1* | 8/2013 | Smith et al. | 220/214 |

FOREIGN PATENT DOCUMENTS

| | | | |
|---|---|---|---|
| EA | 007367 | B1 | 10/2006 |
| EP | 0338844 | B1 | 6/1996 |
| EP | 1074508 | B1 | 5/2004 |
| GB | 2446392 | A | 8/2008 |
| WO | 2004099060 | A2 | 11/2004 |

OTHER PUBLICATIONS

Korean Office Action; Application No. 10-2012-7011378; Feb. 12, 2014; Korean Intellectual Property Office.

* cited by examiner

DISPOSABLE CONTAINER WITH FITTING ATTACHMENT

FIELD OF THE INVENTION

The invention relates to a single use container, also referred to herein as a disposable container, for pressurised liquid, in particular beer, comprising a receptacle providing a storage volume for the liquid, a filling hole formed in the receptacle for filling and tapping of liquid, and a fitting which is arranged in the filling hole.

BACKGROUND OF THE INVENTION

Single use containers or barrels for pressurised liquid are known from the prior art. DE 10 2006 061 120 A1, for example, discloses a single use container in the form of a keg. The keg body comprises an integrally formed neck, in which a single use fitting is directly fixed with a positive or non-positive fit. The single use container is disadvantageously only stackable to a limited extent owing to the neck which projects beyond the bubble-like keg body having the fitting fixed thereto. Owing to their exposed position, there is also the risk of the keg neck and the fitting arranged thereon being damaged during transport or handling of the keg.

SUMMARY OF THE INVENTION

Starting from the above-described prior art, the object of the invention is to provide a single use container for pressurised liquid, in particular for drinks and drinks containing carbon dioxide, which container incorporates the advantages of known single use containers. The single use container should be simple to produce, easy to handle and well storable during filling, transport, storage and use by an end consumer. In particular it further should be able to be filled using conventional filling systems. The fitting should largely be protected from damage, in particular during transport and storage, while still being easy to access.

With regard to the device, the object is achieved by means of a single use container for pressurised liquid, in particular beer, comprising a receptacle providing a storage volume for the liquid, a filling hole formed in the receptacle for filling and tapping of liquid, and a fitting which is arranged in the filling hole, wherein a top attachment unit is arranged on the receptacle and the fitting is held in the filling hole by means of said top attachment unit.

With regard to the method, the object is achieved in a first variant by a method for producing a single use container for pressurised liquid, in particular according to any one of claims 1 to 8, which method comprises providing a receptacle comprising a filling hole, arranging a top attachment unit with fitting on the side or on top of the receptacle, in such a way that said fitting seals the filling hole in a liquid-tight manner, and filling the receptacle with liquid via said fitting. In a second variant, the object is achieved by a method for producing a single use container for pressurised liquid, in particular according to any one of claims 1 to 8, the method comprising providing a receptacle comprising a filling hole, filling the container with liquid via the filling hole and subsequently arranging a top attachment unit with fitting at or on top of the receptacle, in such a way that the fitting seals the filling hole in a liquid-tight manner. In both variants, the fitting particularly advantageously seals the filling hole in a liquid-tight and gas-tight manner, in such a way that when the receptacle is being filled with a drink, it can be pressurised, for example with $CO_2$, and the $CO_2$ cannot escape.

Within the meaning of the invention, a container is to be understood as a cask, keg, single use cask or single use keg. The storage volume of the receptacle or of the container can basically be of any configuration, for example in the typical 2.5, 5, 10, 20, 30 or 50 liter sizes. The receptacle preferably consists substantially of metal, in particular of tinplate or aluminium plate or similar materials. It can however also consist of a plastics material or similar material or of a combination of the specified materials. Advantageously, the receptacle comprises at least one projection or at least one groove or another similar structure, by means of which the top attachment unit can be positioned. In particular, the receptacle can comprise a lid, which is connected to a wall of the receptacle or side wall of the receptacle by means of a lock seam, in such a way that the top attachment unit can be fixed on the lock seam. According to a particular embodiment, the base of the receptacle and the lid are circularly formed and the side wall of the receptacle is formed radially symmetrical. Due to this, production methods and devices for prior art single use containers can be drawn on in a particularly advantageous manner. This relates in particular to machines and systems for producing bases and lids and for joining these to the side wall.

According to the invention, the fitting is held in the filling hole by means of the top attachment unit. Therefore, the filling hole does not have to be formed, as it is the case in prior art, in such a way that the fitting itself can be fixed on or in the filling hole, for example in the form of a neck or similar cylindrical or annular region, which offers sufficient space for the fitting to be fixed. In particular, no direct connection or fixing of the fitting to the receptacle is required. Advantageously, the filling hole can be fitted by simply removing a portion of the container wall, for example by means of punching, which allows the receptacle to be produced in a particularly simple and cost effective manner. Furthermore, the receptacle does not need to be particularly stable in the region of the filling hole in order to allow the fitting or a tapping device to be fixed thereto. This is due to the fact that although the fitting is arranged in the filling hole in a sealing manner, it is not held by the edge of the filling hole or other structures of the receptacle. It is rather held and fixed by the top attachment unit, which is in turn arranged on and fixed to the receptacle at a location which is particularly well-suited for this purpose.

The invention also provides the possibility of the fitting and top attachment unit being able to be pre-assembled. The unit made up of the top attachment unit and the fitting can be inserted and used in different filling systems in a versatile manner. On one hand the receptacle having no assembled top attachment unit with fitting, can be filled in an upstanding position. On the other hand, the container having a pre-assembled top attachment unit with fitting can be filled upside down using a keg filling system.

Moreover, a unit made up of the top attachment unit and the fitting can be used with differently formed receptacles and in particular with differently formed filling hole geometries. In the case of different filling holes and filling hole geometries, a coordination of the fitting and filling hole can be achieved by a sealing means or sealing element arranged between the fitting and the edge of the filling hole, irrespective of the fixing of the fitting.

According to a further embodiment of the invention, the fitting can be formed as a single use fitting, and in particular consist substantially of plastics material. Use of multiple-use fittings also falls within the scope of the invention. As part of a pre-assembly of the top attachment unit, the fitting advantageously can be arranged thereon. It can for example be connected to the top attachment unit via a thread, one or more locking elements or similar. The fitting can otherwise be formed in one piece with the top attachment unit, in such a way that, advantageously, pre-assembly of the top attachment unit and the fitting is not required. The fitting can be formed as desired, in particular as a round planar fitting, a triangular planar fitting or a basket fitting. The fitting can comprise a housing, which is provided with a completely or partially circumferential locking structure, which serves to fix the fitting to the top attachment unit. The fitting formed in one piece with the top attachment unit, or the pre-assembled unit made up of fitting and the top attachment unit can be arranged on the receptacle, in particular on the top thereof, before or after the single use container has been filled.

The top attachment unit can in particular consist completely or partially of plastics material and, according to a further embodiment of the invention, can be arranged on the receptacle by means of at least a locking element, a thread or another similar connection unit. Locking elements allow a particularly simple assembly of the top attachment unit, in the case of which the top attachment unit is simply placed on the receptacle and can automatically lock therewith.

The top attachment unit can particularly advantageously comprise a fixing structure, on which the aforementioned connection unit, in particular the locking elements, can be arranged. The fixing structure advantageously has a basic shape which basically corresponds to the basic shape of the receptacle or the edge of the receptacle. The fixing structure can in particular be substantially annular or cylindrical, in particular in the case of a typically cask-shaped receptacle having an annular edge. The top attachment unit or the fixing structure thereof advantageously attaches to the external form of the receptacle and completes this receptacle in such a way that the receptacle, together with the top attachment unit, forms a barrel shape, which can be transported, handled and stacked particularly well. According to a further embodiment, at least one handle for transporting the single use container can be formed on the top attachment unit, in particular on the fixing structure. It is advantageous for the top attachment unit and/or fixing structure and/or the at least one handle on the side facing away from the receptacle to form a planar surface, at least in regions, which surface can be used as a base or supporting surface when for stacking or storing a plurality of containers according to the invention.

In a particularly advantageous embodiment, the top attachment unit comprises a fitting support, which can in particular be connected to the preferably annular fixing structure via web or strut elements and borne thereby. A top attachment unit formed in this way advantageously requires a comparatively small amount of material, is light and can be easily produced as an injection moulded element. The fitting support can advantageously be centred in relation to the fixing structure, via the web or strut elements, in such a way that when the top attachment unit is assembled on the receptacle at the edge of the receptacle, the fitting support, and thus also the fitting accommodated therein, is centred in relation to the receptacle and is or can be automatically centred to match the filling hole which is usually arranged in the centre of the lid of the receptacle. The fitting support is particularly advantageously basically formed as a hollow cylinder and has one or more shoulder regions which project away from the hollow cylindrical wall thereof, via which shoulder regions the fitting can be arranged in a defined axial position relative to the fitting support and thus relative to the receptacle. The fitting can be centred in relation to the fitting support and the receptacle via the hollow cylindrical wall. The top attachment unit and/or the fitting support can also comprise locking elements which, in the case of a conventionally arranged fitting, cooperate with the locking structure of said top attachment unit and/or fitting support, and fix the fitting in the fitting support.

According to a further embodiment of the invention, a sealing element is arranged in the filling hole, which sealing element seals the fitting to the edge of the filling hole in a liquid-tight and preferably also gas-tight manner. A further function of the sealing element can be that of an adapter element for adapting different filling hole geometries to the fitting. The sealing element can in particular comprise a groove or a projection, which serves to fix the sealing element in the filling hole. In this manner, the sealing element can be pre-assembled in the filling hole of the receptacle before the top attachment unit with fitting is placed thereon, in such a way that the unit made up of the top attachment unit and the fitting can easily be placed onto the receptacle before or after it is filled, the fitting sealing automatically in the filling hole. Alternatively, the sealing element can be pre-assembled or is pre-assembled on the top attachment unit or on the fitting, in such a way that when the top attachment unit with fitting is put into place, the sealing element is automatically inserted into the filling hole, which has not yet been sealed, and positioned here in a sealing manner. Finally, the sealing element can be arranged on the top attachment unit by means of two-component technology.

BRIEF DESCRIPTION OF THE DRAWINGS

Further features and details emerge from the following description of the invention, given by way of example with reference to the figures, in which.

DETAILED DESCRIPTION OF THE INVENTION

Figure 2:
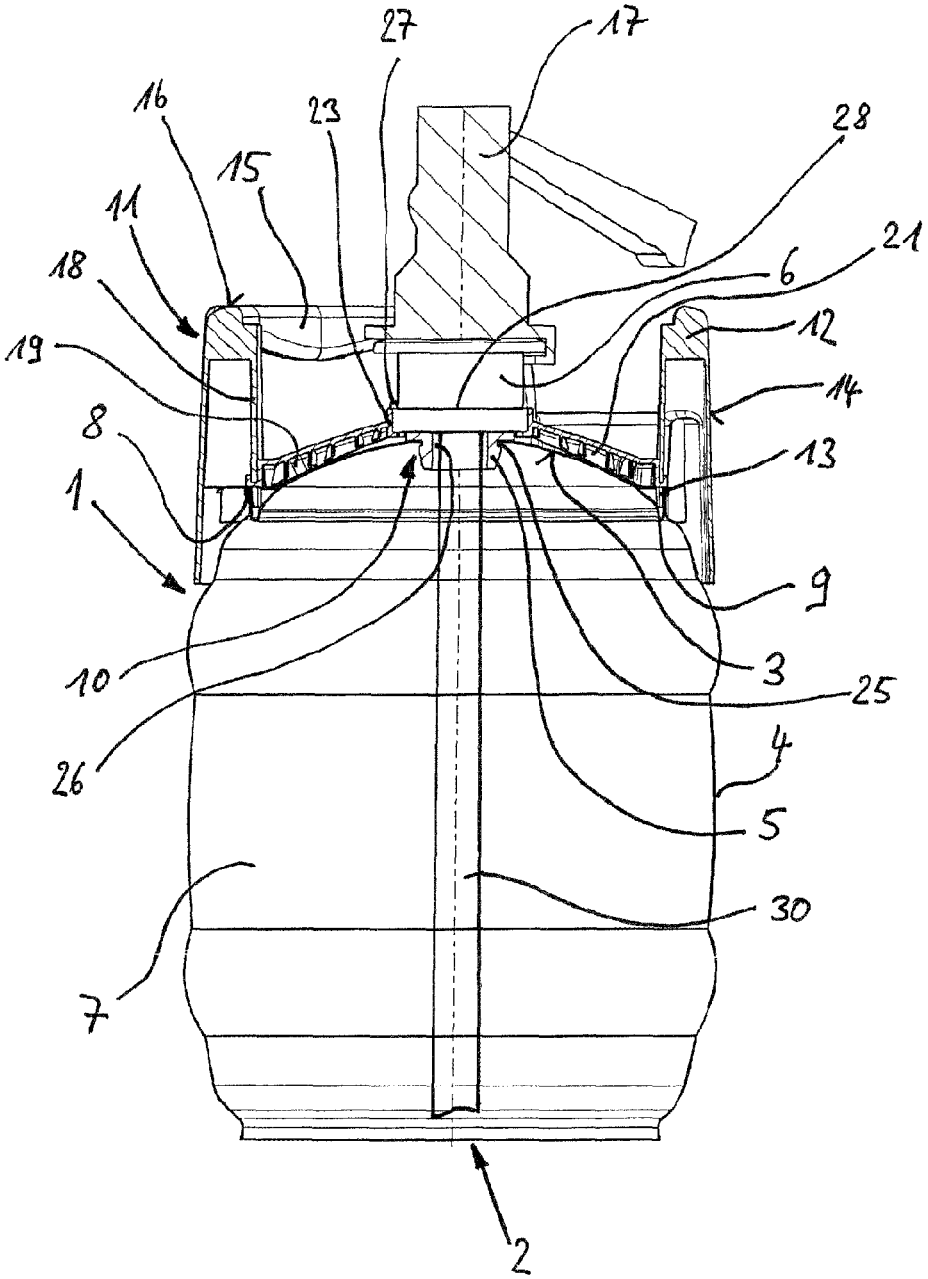
FIG. 2 is a partial sectional view of the single use container of FIG. 1 along the line drawn therein.

The single use container 1 shown in the figures comprises a receptacle 7 having a receptacle base 2 (not visible in FIG. 2), a lid 3 and a receptacle side wall 4. The receptacle base 2 is connected to the receptacle side wall 4 by means of bending up, in such a way that a seam is formed. The lid 3 is connected to the receptacle side wall 4 in a similar manner by means of bending up, in such a way that a seam 8 is formed. The internal region of the lid 3 is formed curving away from the interior of the single use container 1, having an annular circumferential groove 9 formed adjacent to the seam 8, which groove projects in the direction of the containers interior.

Figure 1:
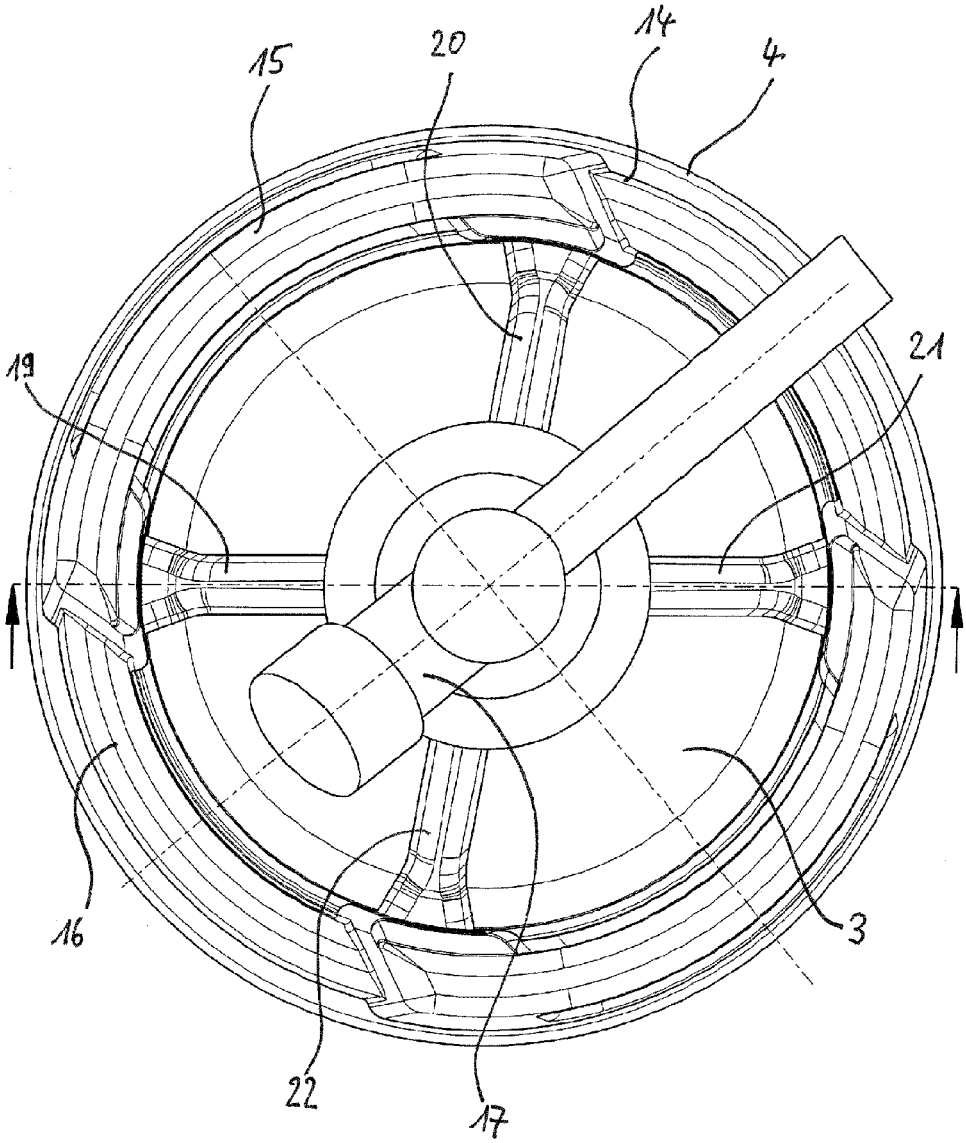
FIG. 1 is a schematic top view of a single use container.
Figure 3:
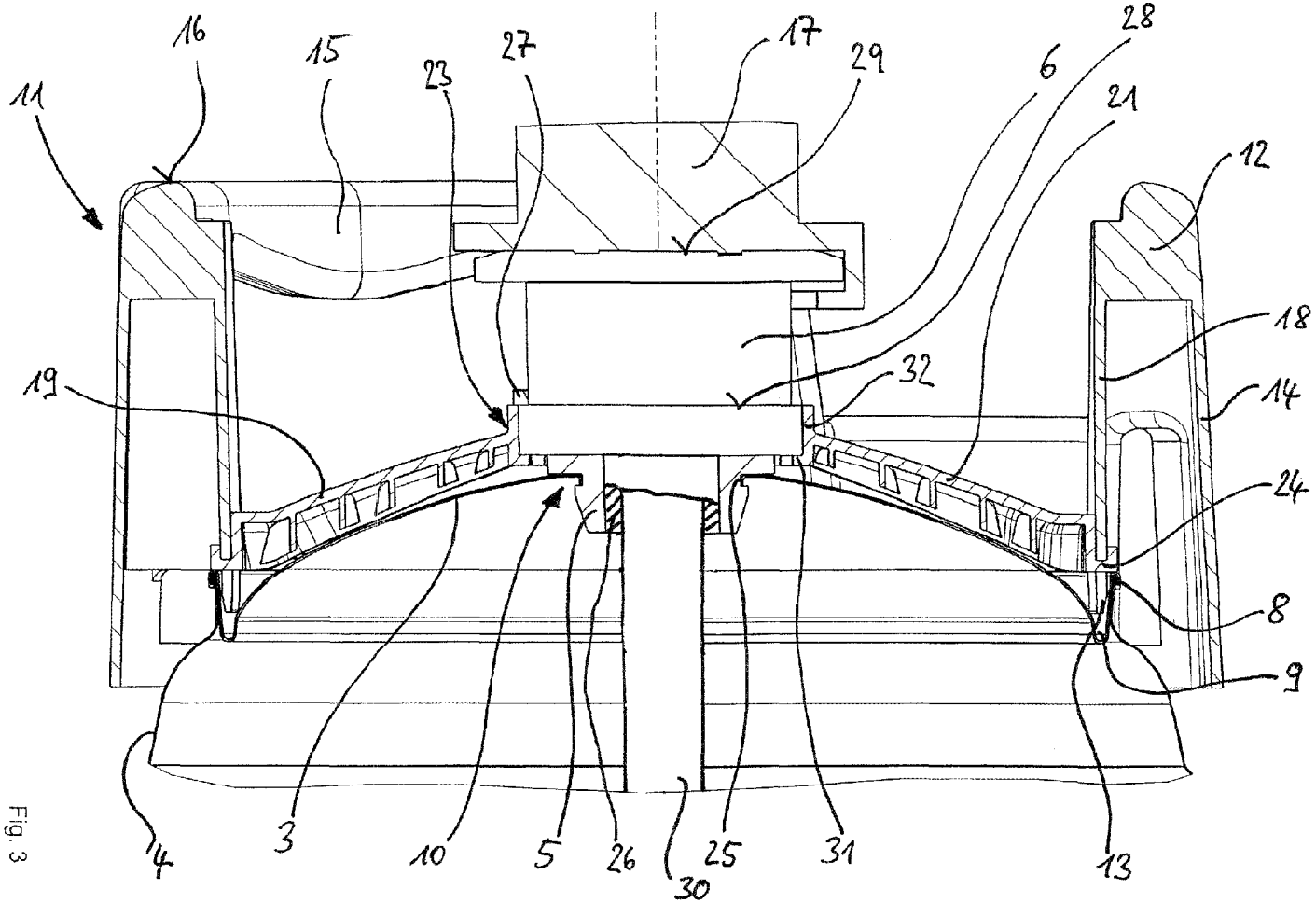
FIG. 3 is an enlarged detail of FIG. 2

A central filling hole 10 is produced in the lid 3, into which, as will be subsequently described in greater detail, a sealing element 5 and a fitting 6 are inserted before or after the single use container 1 is filled. The single use container 1 is shown fully assembled in FIGS. 1 to 3.

A top attachment unit 11 is arranged on the side and top of the receptacle 7. This top attachment unit 11 comprises a substantially annular fixing structure 12, the internal, circumferential edge 13 of which is connected to the seam 8 of the receptacle via locking elements (not shown in greater detail in the figures). The exterior 14 of the fixing structure 12, adapted to the basic shape of the receptacle 7, is pulled down beyond the circumferential edge 13 and attaches basically flush with the receptacle side wall 4.

The fixing structure 12 is provided with two handles 15 on the side thereof facing away from the receptacle 7, the top of which handles is basically aligned with the annular circumferential upper edge 16 of the fixing structure 12. The top of the top attachment unit 11 facing away from the receptacle 7 is thus generally annular and substantially planar, in such a way that a plurality of containers (when a tap head 17 has not been assembled) can easily be stacked and transported.

Figure 4:
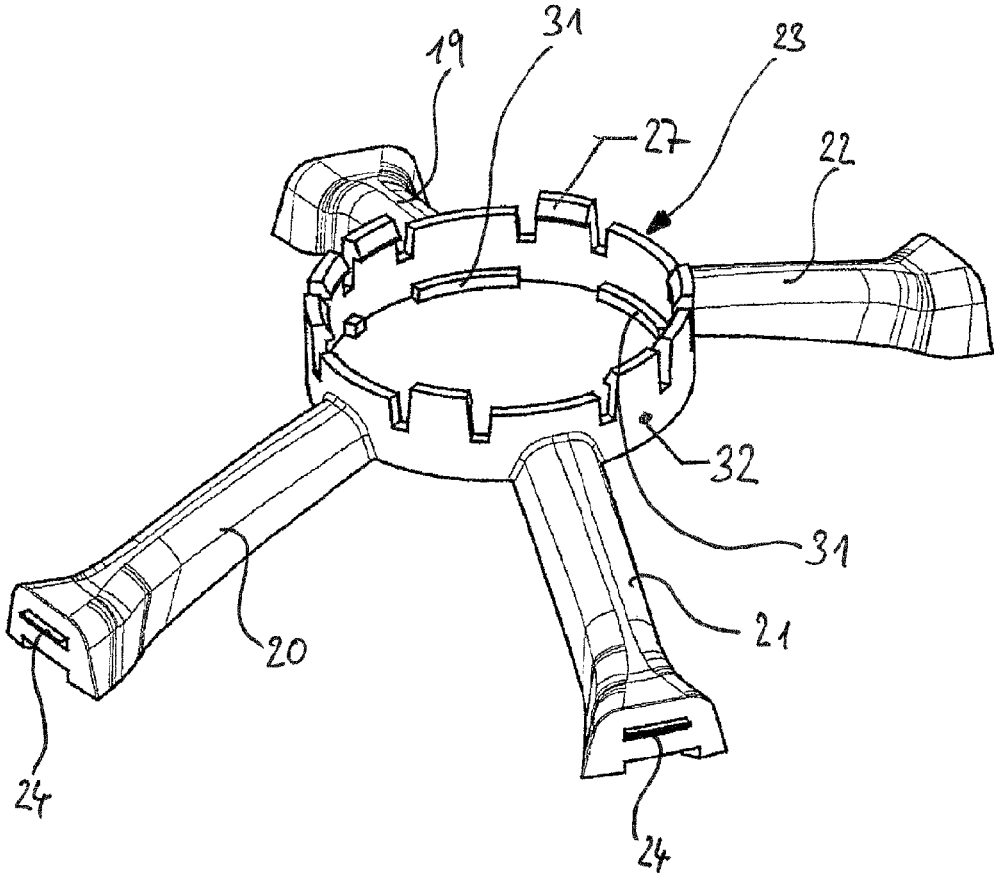
FIG. 4 is a perspective view of a portion of the top attachment unit shown in FIGS. 1 to 3.

Strut elements 19, 20, 21, 22 are arranged on the cylindrical circumferential inner wall 18 of the fixing structure 12. These point from the annular inner wall 18 in the direction of the central filling hole 10 and are connected to a fitting support 23 on their ends which point towards the filling hole, which fitting support is centred relative to the filling hole 10 via the strut elements 19, 20, 21, 22. The strut elements 19, 20, 21, 22 are connected to the inner wall 18 via a tongue-and-groove system 24. The fitting support 23 borne by the strut elements 19, 20, 21, 22 in turn serves to arrange and fix the fitting 6 centred in relation to the filling hole 10. As shown in particular in FIG. 4, the fitting support 23 comprises a substantially cylindrical wall 32, shoulder elements 31 being arranged projecting inwards on the sides thereof which face the receptacle 7, while locking elements 27 can be placed on the side thereof which faces away from the receptacle 7. While the wall 32 centres the fitting 6 relative to the receptacle 7 and the filling hole 10 thereof, the axial position of the fitting 6 is determined by the shoulder elements 31, the fitting 6 being held by the locking elements 27.

A sealing element 5 is arranged between the fitting 6 and circumferential edge of the filling hole 10 and seals the filling hole 10 is a liquid-tight and preferably also gas-tight manner. The sealing element 5 is provided with a circumferential groove 25, into which the circumferential edge of the filling hole 10 engages and holds the sealing element in the case of a conventional arrangement. The sealing element 5 is provided with a central opening, the diameter of which is slightly smaller than the outer diameter of a neck 26, which projects through a filling hole 10, of the fitting 6, in such a way that a sealing attachment of the sealing element 5 to the neck 26 is ensured.

The fitting 6 comprises an externally circumferential step 28, which locks in the fitting support 23 by means of the locking elements 27 thereof in the case of a conventional arrangement of the fitting 6, in such a way that the fitting can be arranged securely and rigidly in the fitting support 23. In the case of a conventional arrangement in the fitting support 23 and the filling hole 10, the top 29 of the fitting 6 does not project beyond the upper edge 16 of the circumferential fixing structure of the attachment 11. In this manner, a good stacking ability and transportability is ensured, even in the case of an assembled fitting. The fitting 6 is also basically protected from damage by the circumferential fixing structure 12.

In the figures, a tap head 17 is shown on the fitting 6 by way of example and is arranged on the fitting 6 in the known manner. A fill or feed pipe 30 also projects from the fitting 6 into the interior of the receptacle 7.

The invention claimed is:

1. A combination of a single use container (1) and a fitting (6) for a pressurized beverage, the container comprising:

a receptacle (7) providing a storage volume for the pressurized beverage, wherein a filling hole (10) is formed in the receptacle (7) for filling and tapping of the pressurized beverage through the fitting (6);

a top attachment unit (11) arranged on the receptacle (7) and holding the fitting (6), which is placed in the filling hole (10) by the top attachment unit;

the top attachment unit (11) comprising a substantially annular fixing structure (12) and a fitting support (23), the annular fixing structure configured for arranging the top attachment unit (11) on the receptacle (7) and the fitting support (23) configured for holding the fitting (6) in place;

whereby the fixing structure (12) is connected to the fitting support (23) via a plurality of spaced apart strut elements, wherein the strut elements and the fitting support (23) are formed as one piece;

wherein the filling hole is formed by removing a part of a wall of the receptacle, and wherein the top attachment unit (11) is configured to not engage the wall of the receptacle in a vicinity of the filling hole.

2. The combination according to claim 1, wherein the fitting (6) is a single use fitting.

3. The combination according to claim 2, wherein the single use fitting is made of plastic material.

4. The combination according to claim 1, wherein the top attachment unit (11) is arranged or fixed on the receptacle (7) by locking elements.

5. The combination according to claim 1, wherein the top attachment unit (11) comprises the fixing structure (12), which is a substantially annular fixing structure, via which the top attachment unit (11) is arranged on the receptacle (7), wherein at least one handle (15) is formed on the fixing structure (12).

6. The combination according to claim 1, wherein at least one handle (15) for transporting the single use container (1) is formed on the top attachment unit.

7. The combination according to claim 1, wherein a sealing element (5) is arranged in the filling hole (10), which sealing element is fixed in the filling hole (10) by a groove (25) or catch projections.

8. The combination according to claim 1, wherein the fitting (6) is connected to the top attachment unit (11) via a thread or locking elements (27, 28).

9. The combination according to claim 1, wherein the fitting (6) is one of a round/planar fitting, a triangular/planar fitting, or a basket fitting.

10. The combination according to claim 1, wherein the top attachment unit (11) is arranged on the receptacle (7) by locking elements on a seam (8) formed between a receptacle side wall (4) and a lid (3), and the top attachment unit has an axially directed leg that is seated in a circumferential groove near the seam.

11. A combination of a single use container (1) and a fitting for a pressurized beverage, the container comprising:

a receptacle (7) providing a storage volume for the pressurized beverage;

a filling hole (10) formed in the receptacle (7) for filling and tapping of the pressurized beverage, wherein the fitting (6) is arranged in the filling hole (10); and a top attachment unit (11) arranged on the receptacle (7), wherein the fitting (6) is held in the filling hole (10) by the top attachment unit (11), the top attachment unit (11) comprising a substantially annular fixing structure (12), thereby arranging the top attachment unit (11) on the receptacle (7) and a fitting support (23) connected to the top attachment unit (11) and the fixing structure (12) by a plurality of circumferentially distributed individual strut elements, wherein the top attachment unit (11) is configured to not engage a wall of the receptacle in a vicinity of the filling hole;

wherein all the individual strut elements and the fitting support (23) are formed as one piece.

12. A combination of a top attachment unit and a fitting for attaching the top attachment unit and the fitting to a single use container (1) holding pressurized beer, the container including a receptacle providing a storage volume for the pressurized beer, wherein a hole (10) is formed in the receptacle (7) for filling and withdrawal of the pressurized beer, wherein the fitting (6) is configured to be introduced into the hole (10), the combination comprising:

the top attachment unit (11) comprising:

a substantially annular fixing structure (12) for arranging the top attachment unit on the receptacle (7) and a fitting support (23) connected to the annular fixing structure by a plurality of circumferentially distributed individual arm shaped strut elements, whereby the fitting (6) is centered by the fitting support (23), suitable for introducing a portion of the fitting into hole (10), wherein the top attachment unit (11) is configured to not engage a wall of the receptacle in a vicinity of the filling hole upon mounting;

locking elements to attach the top attachment unit to a seam (8) formed between a receptacle side wall (4) and a lid (3) of the single use container; and an axially directed leg that is seated in a circumferential groove (9) near the seam.

* * * * *

UNITED STATES PATENT AND TRADEMARK OFFICE

CERTIFICATE OF CORRECTION

PATENT NO. : 8,833,615 B2
APPLICATION NO. : 13/502840
DATED : September 16, 2014
INVENTOR(S) : Neukirch et al.

It is certified that error appears in the above-identified patent and that said Letters Patent is hereby corrected as shown below:

On the title page:

item [75]

First Inventor Werner Neukirch's city: "Andermach", should read --Andernach--.

Signed and Sealed this
Eleventh Day of November, 2014

Michelle K. Lee

Michelle K. Lee
*Deputy Director of the United States Patent and Trademark Office*